United States Patent [19]

Omholt

[11] Patent Number: 4,694,627

[45] Date of Patent: Sep. 22, 1987

[54] RESILIENTLY-CUSHIONED ADHESIVELY-APPLIED FLOOR SYSTEM AND METHOD OF MAKING THE SAME

[76] Inventor: Ray E. Omholt, 1027 Valley Forge Rd. (#414), Devon, Pa. 19333

[21] Appl. No.: 738,611

[22] Filed: May 28, 1985

[51] Int. Cl.[4] ..... E04F 13/08

[52] U.S. Cl. ..... 52/390; 52/393; 52/480; 52/403

[58] Field of Search ..... 52/390, 393, 403, 591, 52/592, 480

[56] References Cited

U.S. PATENT DOCUMENTS

| | | | |
|---|---|---|---|
| 1,925,068 | 8/1933 | Gray | 52/390 |
| 2,156,144 | 4/1939 | Feichter | 52/390 |
| 2,212,126 | 8/1940 | Phillips | 52/346 |
| 2,862,255 | 12/1958 | Nelson | 52/403 |
| 3,090,082 | 5/1963 | Baumann | 52/480 X |
| 3,094,745 | 6/1963 | Stout . | |
| 3,114,940 | 12/1963 | Rockbrand et al. . | |
| 3,185,748 | 5/1965 | MacDonald et al. . | |
| 3,197,358 | 7/1965 | Angioletti et al. . | |
| 3,333,379 | 8/1967 | Harris . | |
| 3,375,633 | 4/1968 | Pourtau . | |
| 3,440,787 | 4/1969 | Bataille . | |
| 3,452,494 | 7/1969 | Prior . | |
| 3,455,076 | 7/1969 | Clarvoe . | |
| 3,472,472 | 10/1969 | Maestrello . | |
| 3,518,800 | 7/1970 | Tank | 52/480 |
| 3,533,896 | 10/1970 | Hartig | 52/390 |
| 3,619,964 | 11/1971 | Passaro et al. . | |
| 3,666,606 | 5/1972 | Stokes . | |
| 3,694,976 | 10/1972 | Warshaw . | |
| 3,736,713 | 6/1973 | Flachbarth et al. . | |
| 3,745,735 | 7/1973 | Casano . | |
| 3,891,732 | 6/1975 | Hurst . | |
| 3,893,271 | 7/1975 | Kotlarz . | |
| 3,969,851 | 7/1976 | Whitacre . | |
| 3,998,023 | 12/1976 | Anderson | 52/393 X |
| 3,998,024 | 12/1976 | Frandsen | 52/393 X |
| 4,089,140 | 5/1978 | McIntyre . | |
| 4,128,982 | 12/1978 | Weaver . | |
| 4,185,432 | 1/1980 | Eriksson | 52/403 X |
| 4,231,197 | 11/1980 | Caplan | 52/747 X |
| 4,233,793 | 11/1980 | Omholt | 52/390 |
| 4,238,914 | 12/1980 | Omholt | 52/403 X |

FOREIGN PATENT DOCUMENTS

| | | | |
|---|---|---|---|
| 119635 | 4/1968 | Denmark . | |
| 803422 | 12/1951 | Fed. Rep. of Germany . | |
| 1812381 | 3/1968 | Fed. Rep. of Germany . | |
| 2103383 | 8/1972 | Fed. Rep. of Germany . | |
| 2609792 | 9/1977 | Fed. Rep. of Germany | 52/403 |
| 2614551 | 10/1977 | Fed. Rep. of Germany | 52/373 |
| 3038919 | 5/1982 | Fed. Rep. of Germany . | |

OTHER PUBLICATIONS

Four-page Brochure, Special Products Division, Johnson Rubber Company, 1961.

*Primary Examiner*—William F. Pate, III
*Assistant Examiner*—Creighton Smith
*Attorney, Agent, or Firm*—Panitch Schwarze Jacobs and Nadel

[57] ABSTRACT

A resiliently-cushioned adhesively-applied floor system is comprised of a plurality of floor panels secured to a support base by an adhesive which is spread on at least one of the support base or the floor panels with a generally uniform thickness. A plurality of elongated support members fabricated from pre-cured elastomeric material are positioned between the floor panels and the support base. The floor panels are forced toward the support base so that the adhesive forms a bond between the floor panels and the support base or between the support members and the support base.

45 Claims, 12 Drawing Figures

FIG. 1
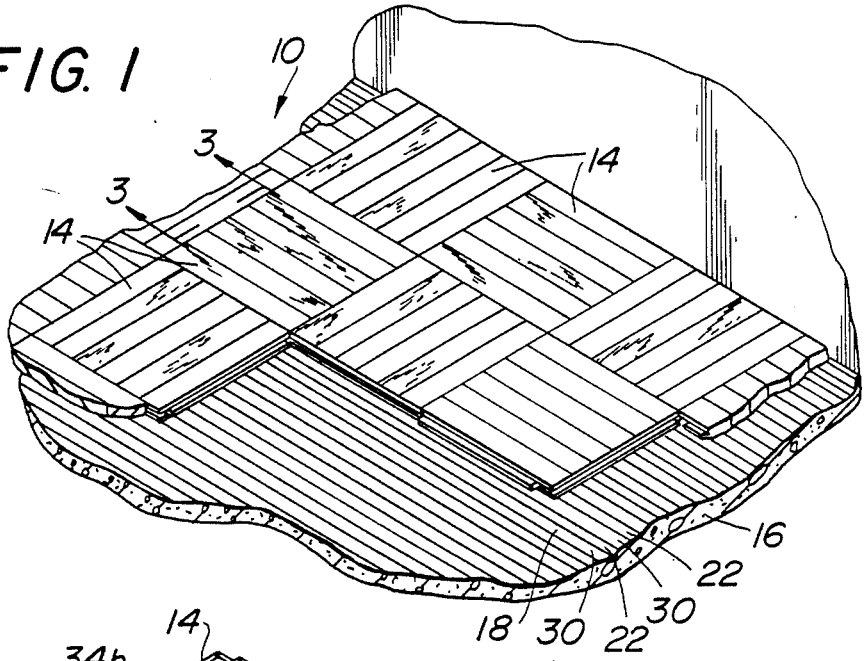
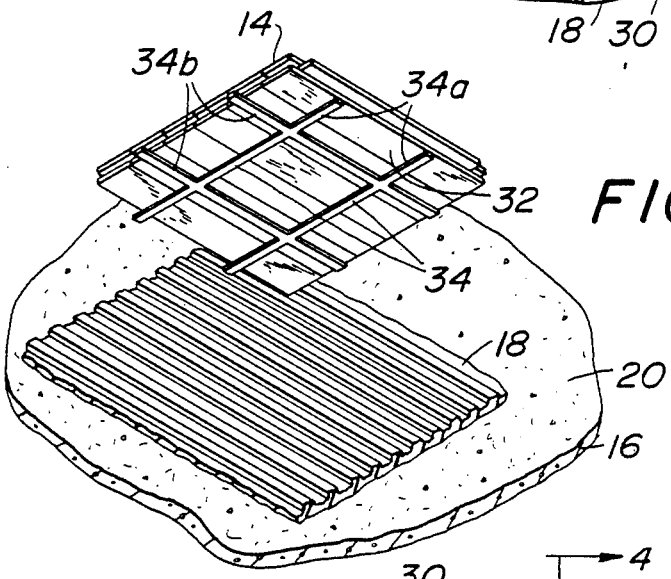
FIG. 2
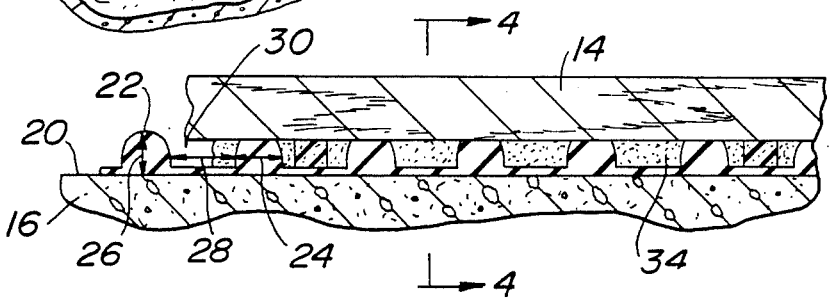
FIG. 3

FIG. 4
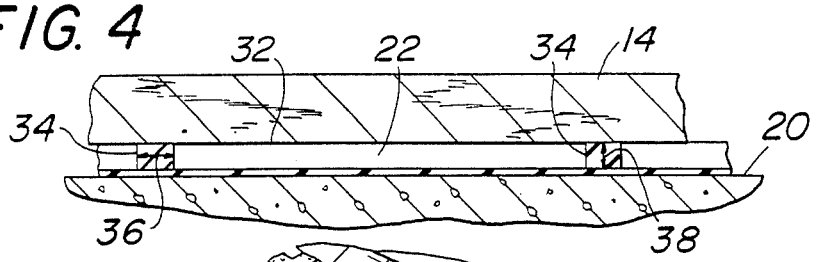
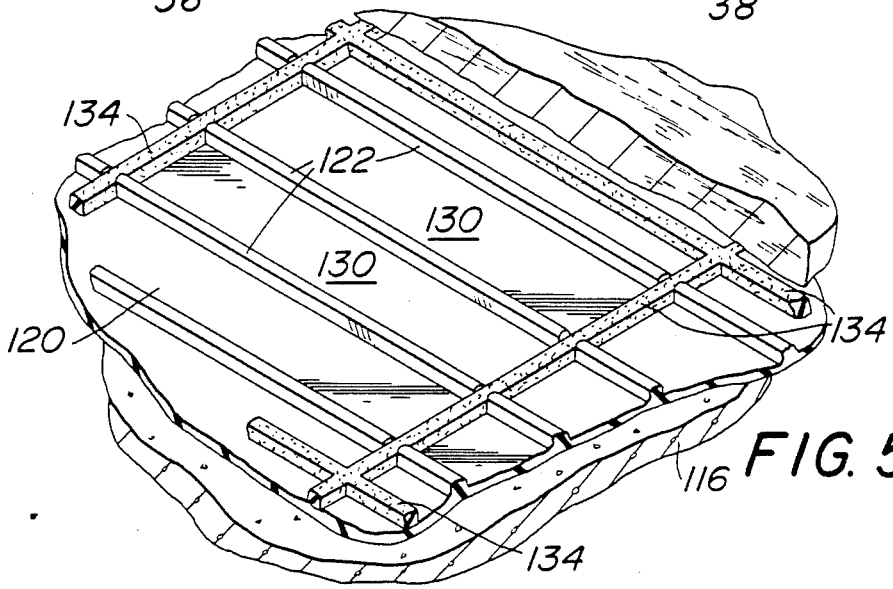
FIG. 5
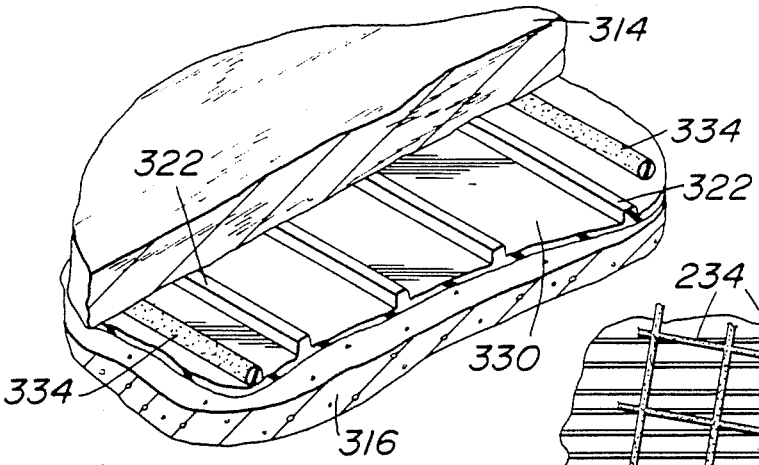
FIG. 6
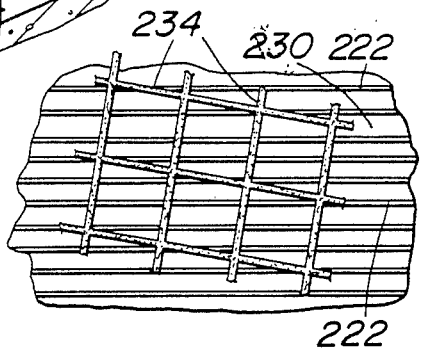
FIG. 7

RESILIENTLY-CUSHIONED ADHESIVELY-APPLIED FLOOR SYSTEM AND METHOD OF MAKING THE SAME

BACKGROUND OF THE INVENTION

The present invention relates generally to the field of floor systems in which a support base is covered by a plurality of floor panels secured to the support base with an adhesive. More particularly, the present invention relates to a floor system which includes a plurality of spaced pre-cured elongated elastomeric support members positioned between the floor panels and the support base for cooperation with an adhesive with vertical grade trowelable viscosity to provide uniform resilient cushioning and uniform elastic energy return for the floor system, to provide a bridging action over depressed spots in an uneven support base, and to provide restraint against unwanted lateral movement or vertical buckling.

Resiliently cushioned floor systems are in common use in gymnasiums and other indoor sporting activity areas, as well as in high-rise residential condominiums and other types of buildings where impact-cushioned comfort underfoot and impact-sound reduction between floors are important design considerations. In such floor systems, a flat upper surface is provided by arranging a plurality of floor panels in a side-by-side abutting relationship to provide a flat surface with essentially no openings between floor panels.

Such resiliently cushioned floor systems should provide for minimum maintenance and, in normal use, should withstand unwanted lateral expansion, buckling, dead spots, warpage, and other forms of surface deficiencies and irregularities. For indoor sporting areas, a floor should be resiliently cushioned to help prevent leg injuries, such as shin splints, and should have good elastic energy return to help reduce fatigue from vigorous exercising. The floor surface should also absorb impact-generated sound between floors of multi-story buildings.

U. S. Pat. No. 4,233,793, issued to Ray E. Omholt, inventor of the floor system described in the present application, shows and describes a resiliently cushioned wood flooring system and a method for installing such a system and is hereby incorporated by reference. In the system described in the Omholt patent, wooden flooring members or floor boards are secured to a support base utilizing an uncured elastomeric adhesive which is spread on either the support base or on the floor boards or on both in spaced ridges with a relatively uniform thickness. Typically, the adhesive is applied to the support base. Spherical beads of a uniform diameter and made of a material such as cured elastomeric urethane, styrene, or some other material which will easily deform under subsequent walking loads once the floor is in use are installed between and within the adhesive ridges. The diameter of the beads is selected to be less than the thickness of the uncured adhesive ridges being applied. The beads have the initial support capability needed to maintain the floor boards at the desired distance above the support base during installation under the relatively light hand-loading applied by flooring installers as the flooring is forced down into the relatively soft vertical-grade elastomeric adhesive while the floor boards are being laid. The beads do not, and are not intended to, provide resistance to deformation under the force of walking and other loads which are applied to the floor in normal use. Once the elastomeric adhesive is cured, the adhesive cooperates with the gaps or spaces between the adhesive ridges to provide resilient cushioning and support for the flooring system, and the initial vertical spacing function provided by the spherical beads is no longer of consequence.

Although the wood flooring system and the method of installation shown and described in the aforementioned patent have gained widespread acceptance, the flooring system suffers from certain drawbacks which limit its use under some circumstances. One such drawback is that it is difficult to be sure that the flooring installers laying the floor are using the proper number of beads and that the flooring installers are positioning the beads properly to initially support the floor boards at the desired height from the support base during the curing of the elastomeric adhesive. The careful positioning of the beads in the elastomeric adhesive as it is being spread and before the flooring is laid is very time consuming, and some floor installers may have a tendency to reduce the number of beads under the flooring or a tendency to eliminate the beads entirely in order to save time and effort, thus adversely affecting the cushioning and the impact-sound absorbing qualities of the floor.

Another drawback of the prior flooring system is that even if the proper number of beads are utilized, and even if the beads are uniformly distributed over the support base, the beads do not provide enough support to permit the floor to be walked on until after the elastomeric adhesive has cured for a period of time which is normally not less than twenty-four hours. In the installation of cushioned flooring in commercial buildings, such as high-rise buildings, workers of non-flooring trades frequently cannot be kept off a freshly-laid floor for the time required for the elastomeric adhesive to properly cure, due to the demands of their own work schedules. Thus, it is not uncommon that someone on a commercial job might walk on a newly-laid floor causing severe damage such as adhesive squeeze-through between the floor boards and poor cushioning and poor sound attenuation between floors in the areas where the floor was walked on prior to curing. It would also be necessary to repair or replace the damaged floor boards, a costly and time consuming job.

Another drawback of the prior flooring system is that localized depressions in a concrete support base known as "bird baths" can cause substantial problems if the floor boards being applied have a length which spans the depression. Since the elastomeric adhesive is applied in a uniform thickness, the adhesive would not contact the backs of the floor boards spanning the depression if the depression being spanned by the boards were deeper than the thickness of the adhesive being applied. The spherical beads positioned in the adhesive might be the only material in contact with the bottoms of the floor boards in question. The spherical beads are inadequate for supporting the floor boards after the adhesive has cured and walking loads are applied to the floor since the spherical beads will become crushed resulting in the floor being unsupported in the area spanning the depression.

Another drawback of the prior flooring system is that the amount of elastomeric adhesive required to provide resilient cushioning is substantial, and the work of applying it is messy. This effectively prohibits the installation of pre-finished flooring using this method, and pre-finished flooring is the flooring of choice in high-rise construction because of the ever present dirt which makes on-the-job finishing of the floors in a satisfactory manner almost impossible.

The present invention overcomes the foregoing drawbacks and deficiencies of the flooring system of the prior patent by providing a plurality of pre-cured elongated elastomeric cushioning support members which fully support the floor panels under initial and in-use loads. The pre-cured elastomeric support members positioned between the support base and the floor panels are designed to be able to support normal walking loads, even if the floor is freshly-laid, so that substantially no support is required from the uncured elastomeric adhesive. Utilizing elongated elastomeric support members which are preferably in the form of a generally continuous open grid, there is no problem with lack of initial support over the entire surface area to be covered by the floor panels. The present invention also reduces substantially the potential problem of adhesive squeezing up between floor boards, a problem which might normally be anticipated if a newly-laid floor was walked on prior to curing of the elastomeric adhesive.

It is common in the flooring industry for floor panels to have a substantial length and a rather narrow width. Such panels are able to easily span "bird bath" depressions in concrete support bases during installation. An example of such flooring might be oak-surfaced plywood planks measuring about six feet in length and about four inches in width. Another example might be plywood sheets intended for use as a subfloor and measuring eight feet by four feet. It should be noted that it is quite common in the flooring industry for the support base in gymnasiums or in high-rise condominiums to be constructed of concrete, and for the surface of the concrete to be somewhat irregular. Heretofore, such unevenness in the support base has resulted in hollow sounding spots, inadequate support, and dead spots under impact on the floor where the floor panels are bridging depressed locations in the support base. With the current invention, the pre-cured elongated elastomeric support members and the elastomeric adhesive ridges cooperate to overcome the problem caused by minor surface depressions without the sacrificing of support for the floor over such depressions once the adhesive has cured since the effective support distance between the support base and the floor is the combined thickness of the support members and the thickness of the applied adhesive.

With the flooring system of the above-identified Omholt patent, bridging could result in the bottoms of the floor panels being lifted above contact with the applied adhesive over low spots in the support base, leaving the floor panels supported only by contact with the crushable spherical beads. With the present invention, pre-cured elongated elastomeric support members which can fully support the floor panel under normal in-use loads can be attached to the under-side of the floor panels at the point of manufacture. Where such floor panels span unevenness in the support base, great flexibility of support can be obtained. Where a localized portion of the support base is high, the elongated support members penetrate the soft uncured elastomeric adhesive as required. Where a localized portion of the support base is low, it is only necessary for the bottoms of the elastomeric support members to be in contact with the elastomeric adhesive ridges for firm support to occur after the elastomeric adhesive has cured. This is a vital quality control to assure control of dead spots while preserving the desired minimum degree of cushioning and impact-sound attenuation in the case of multi-story residential buildings.

Most support bases located on-grade (resting directly on earth) are formed with concrete slabs. Water vapor from damp earth underneath frequently penetrates such slabs and causes unwanted expansion and warpage to wood-based materials laid over such on-grade slabs. By using a moisture-curing elastomeric adhesive to secure the floor panels to the support base, the water vapor problem is very frequently overcome because of the inherent ability of the adhesive material to control the penetration of water vapor coming through on-grade concrete slabs. One preferred such adhesive material, Tremco V-60, is produced by Tremco, Inc., in Cleveland, Ohio, and is a one-component vertical-grade urethane elastomer with a perm rating of 0.02 metric perm-centimeters when tested in accordance with ASTM E96-66, Procedure E. Another effective method for dealing with dampness coming from damp support bases is to position a generally continuous moisture-resistant membrane layer between the undersurface of the floor panels and the upper surface of the elastomeric support members.

By applying the elongated elastomeric support members to the bottom side of the floor panels at the point of manufacture, all questions of potential improper spacing of the support members or of a less-than-designed cushioning height beneath the floor panels or of improper impact-sound reduction under the floor panels caused by installer error or minor variations in the planarity of the support base are eliminated. The end result is a floor system with a much higher degree of predictable cushioning and impact-sound absorbency, a floor system with a substantially greater tolerance for the unevenness which can be anticipated in many concrete support bases, a floor system which makes possible a substantially faster application of the floor panels, and a much neater job with less likelihood that any of the floor panels might have to be replaced due to installer error, uneven concrete, or due to the carelessness of workers from other trades. Also, with a very wide selection of pre-cured elastomeric support members from which to choose, degrees of cushioning and elastic rebound energy become much more predictable, and the neatness of installation makes possible the use of pre-finished flooring.

SUMMARY OF THE INVENTION

Briefly stated, the present invention comprises a resiliently-cushioned adhesively-applied floor system comprised of a plurality of floor panels secured to a support base by an elastomeric adhesive. The adhesive is spread in its uncured state on at least one of the support base or the flooring panels in spaced ridges of a generally uniform thickness. A plurality of spaced elongated support members fabricated of a pre-cured elastomeric material are positioned between the floor panels and the support base. The depth of the support members is less than the initial thickness of the uncured adhesive ridges. The floor panels are forced toward the support base until the support members located between the floor panels and the support base prevent further movement as they come in contact with both the support base and the floor panels. The adhesive ridges form an intimate bond between the support base and the floor panels. In the preferred embodiment, the support members form a generally continuous open grid. The support members and the elastomeric adhesive ridges cooperate to provide cushioned, resilient support for the floor panels.

BRIEF DESCRIPTION OF THE DRAWINGS

The foregoing summary, as well as the following detailed description will be better understood when read in conjunction with the appended drawings. For the purpose of illustrating the invention, embodiments which are presently preferred are shown in the drawings. It is understood, however, that this invention is not limited to the precise arrangements and instrumentalities shown. In the drawings:

FIG. 1 is a top perspective view, partially broken away, of a partially completed floor system in accordance with the present invention;

FIG. 2 is a slightly enlarged perspective view, partially broken away, of a portion of the floor system of FIG. 1 showing the underside of an uninstalled floor panel;

FIG. 3 is an enlarged sectional view of a portion of the floor system taken along lines 3—3 of FIG. 1;

FIG. 4 is a sectional view of a portion of the floor system taken along lines 4—4 of FIG. 3;

FIG. 5 is an enlarged perspective view, partially broken away, of a floor system in accordance with an alternate embodiment of the present invention;

FIG. 6 is an enlarged perspective view of a floor system in accordance with another alternate embodiment of the present invention;

FIG. 7 is a plan view of a portion of a floor system in accordance with yet another embodiment of the present invention;

DESCRIPTION OF PREFERRED EMBODIMENT

Figure 8:
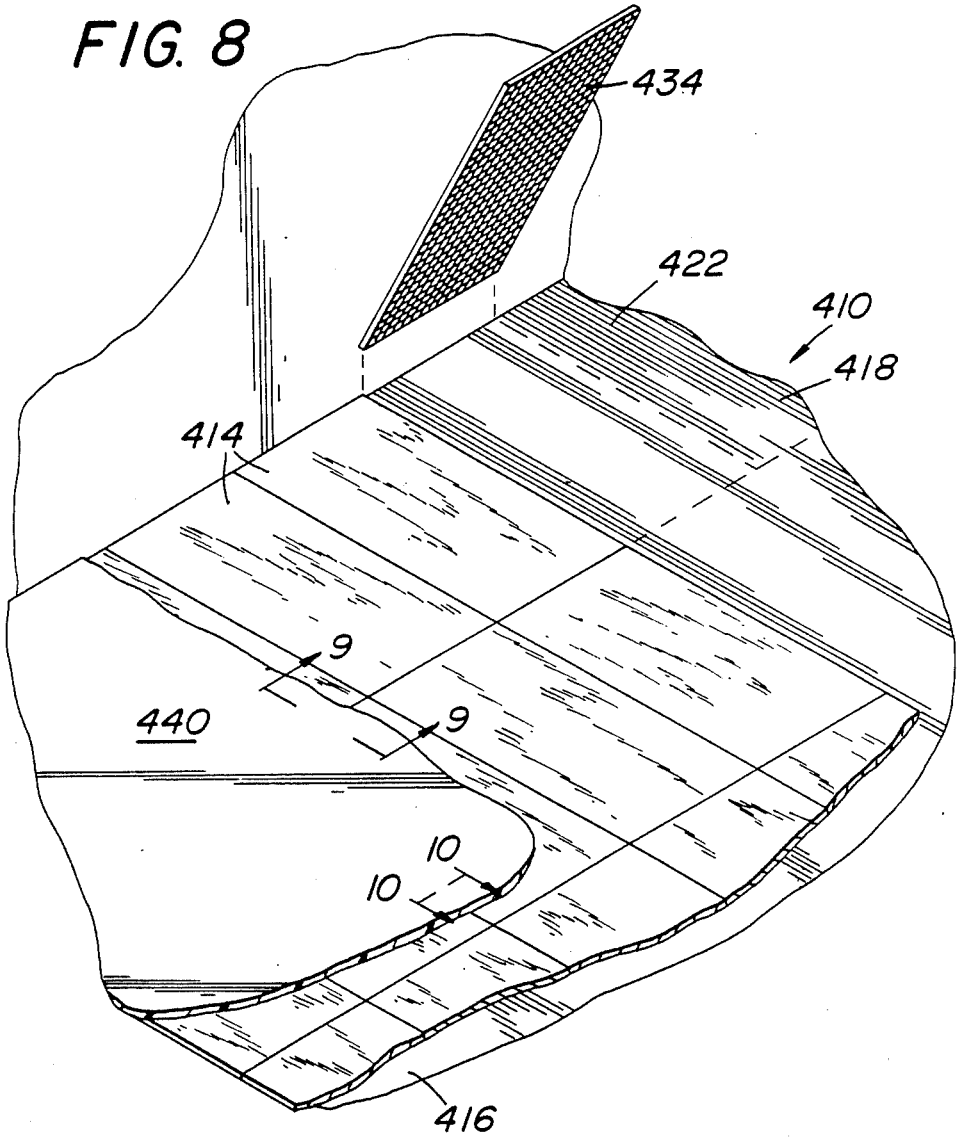
FIG. 8 is a top perspective view, partially broken away, of a partially completed floor system in accordance with yet another embodiment of the present invention.

Referring in detail to the drawings wherein like numerals indicate like elements throughout, there is shown in FIG. 1 a perspective view of a resiliently-cushioned adhesively-applied floor system 10 in accordance with the present invention. The floor system 10 is comprised of a plurality of individual floor components which, in the embodiment shown in FIG. 1, are conventional wooden floor boards or floor panels 14 arranged in a parquet configuration. It should be understood that any other type of floor panel could alternatively be employed in accordance with the present invention. Some examples are ⅜" thick random width and random length plywood floor boards with an oak surface veneer, plywood sheets, ceramic panels, urethane or polyvinylchloride panels or sheet goods, waferboard sheets, etc. The floor panels could also be arranged in any type of configuration or pattern.

The floor panels 14 are secured to a support base 16 which may be concrete, wood, or any other material suitable for forming a generally planar surface for supporting the floor panels 14. In the present embodiment, the floor panels 14 are secured to the support base 16 by an elastomeric adhesive 18 which has been spread in its uncured state onto the upper surface 20 of the support base 16. The elastomeric adhesive 18 is of the type which, after it is cured, provides a high strength bond between the floor panels 14 and the support base 16. In the present embodiment, the adhesive is a one-component moisture-curing urethane elastomer having a cured hardness which may vary between approximately A35 to A70 using the Shore elastomeric rubber hardness scale. An example of a suitable one-component moisture-curing urethane elastomer is Tremco V-60 vertical-grade urethane elastomer as manufactured by Tremco Corporation of Cleveland, Ohio. Alternatively, a two-component urethane or other type of elastomeric adhesive of comparable cushioning and tensile strength may be employed.

A one-component urethane is presently preferred because, unlike the two-component type of adhesive, it does not require precise field-mixing, and a specific and limited mixing time for proper blending of the components is not required. There is also no need for tightly controlling the humidity and moisture conditions in the work area at the time of installation, precautions which are required when working with most two-component urethane adhesives. In addition, with a one-component moisture-curing urethane adhesive, there is ample open time, up to several hours, so there is very little need to closely control the time of the application of the adhesive to the support base or substrate and the application of the floor panels into the adhesive as is the case with two-component urethanes. From a practical standpoint, a one-component adhesive is also generally safer and easier for an installer to use.

As shown in FIGS. 1 and 2, the adhesive 18 is applied to the upper surface 20 of the support base 16 in a plurality of ridges 22 which are of a generally uniform width 24 and a generally uniform thickness 26. The ridges 22 are also generally uniformly spaced a predetermined distance 28 to provide a plurality of generally elongated spaces 30 (see FIG. 3). The width 24 and thickness 26 of the ridges 22 and the width 28 of the spaces 30 may vary depending upon the construction of the particular floor panels 14 and the expected usage. In the presently preferred embodiment, when installing generally square wooden floor panels 14 of the parquet type comprised of five individual floor boards bonded together to form a generally square panel having a dimension of approximately $4\frac{3}{4}$ inches on a side, the adhesive ridges 22 are approximately 3/16 inch in initial thickness (dimension 26) by ¼ inch in width (dimension 24) and are spaced approximately ¼ inch apart (dimension 28).

The adhesive 18 may be applied utilizing a trowel or other type of tool (not shown) having a serrated edge comprised of a plurality of projections or teeth (not shown) which are suitably sized and spaced to provide the desired adhesive ridge height, width and spacing pattern. In the present embodiment, the adhesive ridges 22 extend generally parallel to each other as shown in FIG. 1. However, it should be understood that the ridges 22 need not be parallel and could be formed into any other type of pattern, as long as sufficient adhesive 18 and spacing 30 are provided to form the required bond between the flooring panels 14 and the support base 16.

Prior to forcing the floor panels 14 into engagement with the adhesive 18, a plurality of elongated elastomeric support members 34 (hereinafter sometimes referred to as support member means) are positioned between the floor panel undersurface 32 and the support base upper surface 20. The support members 34 are fabricated of pre-cured elastomeric material to permit resilient vertical deflection of the floor panels 14 under the loads and impacts anticipated in a particular application in order to provide the desired degree of uniform resilient cushioning, elastic energy return, and through-the-support-base impact-sound-reduction. In the present embodiment, the elastomeric support members 34 are fabricated of a material having a Shore durometer in the range from about A35 to A70, and preferably between A45 and A65. Preferably, the support members 34 provide a Lupke rebound rating of 60 or higher and/or a Bayshore rebound rating of 25% or higher and have a compression set of 25% or less when tested in accordance with ASTM D395 Method B 25% deflection, 0.47" gauge thickness. For example, the support members 34 may be formed of a thermoplastic polymerized polyolefinic compound blend of polypropylene rubber with EPDM rubber known as SANTOPRENE which is manufactured by Monsanto Chemical Company of St. Louis, Mo. Other examples of elastomeric materials which may be used include: vulcanized natural rubber; polyethylene rubber compounds; polypropylene rubber compounds; urethane rubber compounds; polyvinylchloride rubber compounds; silicone rubber compounds; EPDM rubber compounds; neoprene rubber compounds; and ABS rubber compounds.

The use of an elastomeric adhesive 18 in combination with the elastomeric support members 34 provides a floor system having uniform and good resilient cushioning and elastic energy return while restricting lateral and/or upper buckling movement of the floor panels 14 during periods of moisture-induced stress.

Although the dimensions of the support members 34 vary, depending upon the geometry of the floor panels 14 and the degree of support, cushioning and bonding required, in the present embodiment each support member 34 has a width 36 which is at least slightly less than the initial width 28 of the spaces 30 between the adhesive ridges 22. The support members 24 also have a depth or thickness 38 which is at least slightly less than the initial thickness 26 of the adhesive ridges 22. When installing wooden parquet floor panels 14 utilizing adhesive ridges 22 having the height, width and spacing as described above, the support members 34 are generally square in cross section, having a width 36 of $\frac{1}{8}$ inch and a height 38 of about $\frac{1}{8}$ inch. The support members 34 are also spaced in a grid pattern approximately two inches on center to provide a contact area ratio between the upper surface of the support members 34 and the undersurface 32 of the floor panels 14 of approximately twelve and one-half percent.

Alternatively, if adhesive 18 were applied in a thickness 26 which had a lesser height than the height 38 of the support members 34, then the support members 34 would provide exclusive direct support for the undersurface 32 of floor panels 14. In this case, the grid pattern spacing of support members 34 might be reduced to approximately one inch on center to provide a contact area ratio of approximately twenty-five (25%) percent.

By properly combining design variables relating to the elastomeric support members, a floor with predictable and uniform resilient cushioning and elastic energy return and with an ability to absorb impact-generated sounds over a wide range of impact loadings can be obtained. The primary design variables relating to the elastomeric support members are:

1. The contact area ratio of the support members
2. The thickness of the support members
3. The spacing of the support members
4. The durometer rating of the support members
5. The rebound rating of the support members
6. The compression set rating of the support members As discussed briefly above, the primary purpose of the elongated support members 34 is to provide uniform resilient cushioning and elastic energy return for the floor 10, to support the floor panels 14 at a uniform height above the support base upper surface 20, to provide a predetermined support to the floor panels 14, and to cooperate with the elastomeric adhesive 18 in bridging minor depressions in the support base upper surface 20. In the present embodiment, two support members 34 support each individual piece of flooring panel 14, the two support members 34 being generally parallel to each other and uniformly spaced by a predetermined distance. The two support members 34 are also oriented to be generally perpendicular to the long or major axis of the floor panel 14. However, the support members 34 could be oriented at any other angle with respect to the long or major axis, as long as they are arranged to preclude tilting of the floor panel 14. In the case of the parquet floor panels shown in FIGS. 1–4, at least two support members 34 extend perpendicular to the individual floor boards.

In the embodiment shown in FIGS. 1 through 4, the support members 34 are generally parallel to each other and are uniformly spaced from each other by a predetermined distance. The support members 34 of the embodiment shown in FIGS. 1 through 4 also comprise a generally continuous square open grid-like structure. As best seen in FIG. 2, the grid structure is comprised of two groups of support members 34. The first group of support members is comprised of two generally parallel support members shown as **34*a* which extend generally perpendicular to the major axis of the floor panel 14. The second group of support members is also comprised of two generally parallel support members indicated as 34*b*. In the present embodiment as best shown in FIG. 2, the support members of the first group 34*a* are generally perpendicular to the support members of the other group 34*b* to form the generally square open grid structure. The square grid structure could be formed by extruding perpendicular strips of elastomeric material and then pressing them together while still hot to fuse the strips together. However, it will be appreciated by those skilled in the art that the support members of the first group 34*a* could be arranged at any other angle with respect to the support members of the other groups 34*b* or could be interconnected to provide a grid structure having some other shape, for example, diamond shaped. Alternatively, the support members 34** could run generally parallel to each other with no intersecting members.

As shown in FIG. 2, a small portion of each of the support members **34*a* and 34*b* extends slightly beyond the edge of the floor panels 14. Also, on the opposing edge, the support members 34*a* and 34*b* recede slightly inwardly of the edge of the floor panels 14. The small extended portions of the support members are employed to help support non-tongued and grooved adjacent floor panels 14** at a uniform height during the installation of the floor panels.

In the embodiment shown in FIGS. 1 through 4, as best shown in FIG. 2, the support members 34 are initially secured firmly to the floor panel under-surface 32. The support members 34 may be secured to the floor panel undersurface 32 at a manufacturing facility (not shown) where the floor panels 14 are made or may be secured to the floor panel undersurface 32 at a remote location, for example, just prior to the installation of the floor panels 14. Alternatively, the support members 34 could be installed upon the support base 16 prior to the installation of the floor panels 14. The support members 34 may be secured to floor panels 14 utilizing any suitable adhesive or bonding agent, for example, a solvent-based adhesive such as polypropylene or a hot-melt adhesive such as styrene resin.

As previously noted, one of the primary purposes of the support members 34 is to provide uniformly cushioned support of an assured minimum thickness under the floor panels 14, not only during the curing of the adhesive 18, but continuously thereafter. The support members 34 provide immediate initial support so the floor can be walked on very shortly after installation, as soon as the initial tack of the adhesive has set up to prevent lateral skidding of the floor panels 14 under walking loads. This is an important advantage since it permits workers from other trades to continue to perform their jobs without having to wait an excessively long time for the adhesive 18 to cure. Since the support members 34 are designed to provide the majority of the support, resilient cushioning, elastic energy return, and impact-sound reduction, the adhesive 18 need not serve the function of supporting the flooring panels 14 and need only serve to adhesively hold the floor panels 14 in place, thereby also permitting the use of less adhesive than with prior art flooring systems and permitting greater spacing between the adhesive ridges 22.

FIGS. 3 and 4 provide cross sectional views of a floor panel 14 which has been installed in accordance with the present invention. As shown in FIGS. 3 and 4, the dimensions of the support members 34 relative to the thickness of the adhesive ridges 22 assure that the adhesive ridges 22 properly contact the floor panel 14 to provide a high level of bonding between floor panel 14 and the support base upper surface 20. The support members 34 cooperate with the adhesive ridges 22 and the spaces 30 between the adhesive ridges 22 to provide continuous resilient cushioning for the floor panels 14 from the time of installation, as well as providing impact-sound absorption. The edges of adjacent floor panels 14 are also supported by the support members 34 at substantially the same elevation, thus causing adjacent floor panels 14 to provide a substantially flat upper surface.

FIGS. 5, 6, and 7 show embodiments of the invention which are variations of the embodiment shown in FIGS. 1 through 4. In the embodiment shown in FIG. 5, the elongated elastomeric support members 134 are formed into a generally square open grid substantially the same as that of the embodiment of FIGS. 1 through 4. However, in the embodiment shown in FIG. 5, the support members 134 are initially installed on the support base upper surface 120 and are embedded within the spaced and generally parallel adhesive ridges 122. In addition, the adhesive ridges 122 of FIG. 5 are spaced farther apart than those of the embodiment shown in FIGS. 1 through 4. The support member grid is oriented so that some of the support members 134 are generally parallel to the adhesive ridges 122 and are located within the spaces 130 between the adhesive ridges 122, while other support members 134 extend generally perpendicular to the adhesive ridges 122.

FIG. 7 shows an arrangement similar to that of FIG. 5. However, in the arrangement shown in FIG. 7, the support members 234 are positioned at an angle with respect to the adhesive ridges 222. In this manner, the support members 234 are not located within the spaces 230 between the parallel ridges 222 nor do the support members 234 extend perpendicular to the ridges 222.

In the embodiment shown in FIGS. 5 and 7, the grid which is formed of the support members 134 or 234 could be a generally continuous flexible roll of support member grids (not shown) or could be formed of a plurality of individual support grids (not shown) of a predetermined length and width. Alternatively, the support grid could be cut into squares (not shown), each having a plurality of individual support grids and having dimensions generally corresponding to those of the floor panels being laid.

In the embodiment shown in FIG. 6, individual elongated support members 334 which are not connected in any particular grid formation are employed. The individual support members 334 in this embodiment are generally circular in cross section and are positioned within the spaces 330 between the adhesive ridges 322. Alternatively, the elongated support members 334 could be positioned in any other orientation with respect to the ridges 322, for example, at a 45 degree angle (not shown). As discussed above, the support members 334 extend generally perpendicular to the major axis of the floor panels 314 if there is such an axis.

Figure 9:
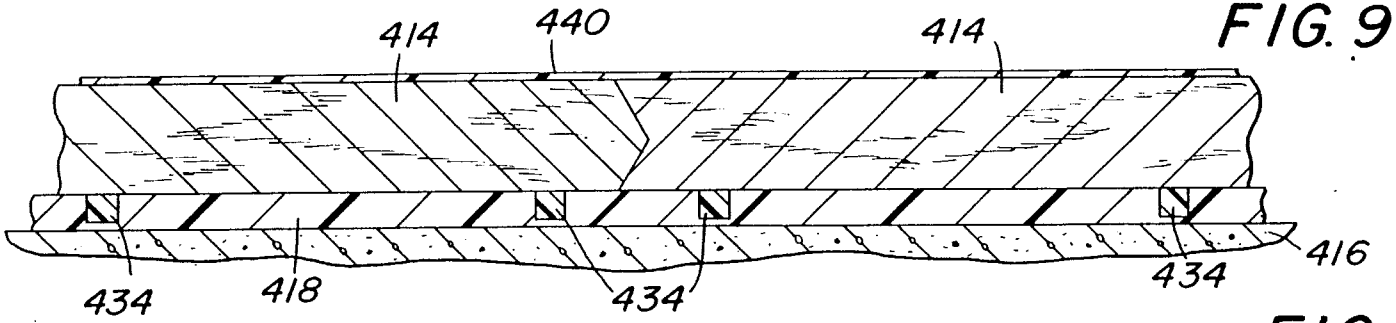
FIG. 9 is an enlarged sectional view of a portion of the floor system taken along line 9—9 of FIG. 8.
Figure 10:
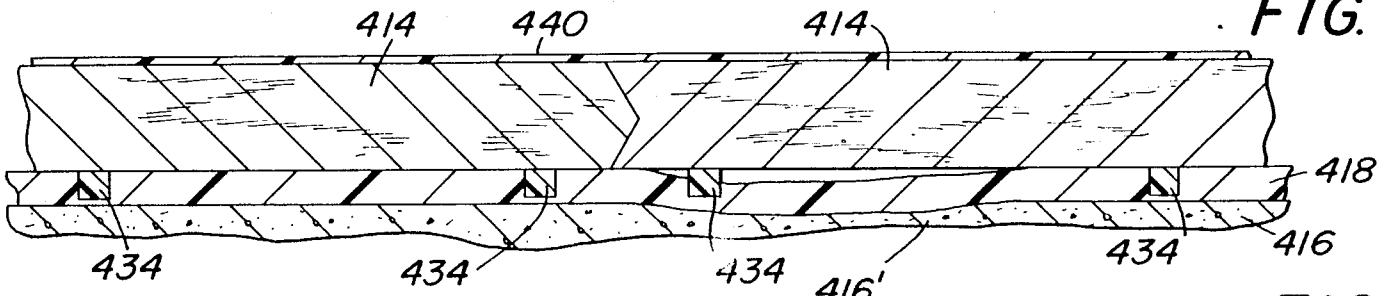
FIG. 10 is an enlarged sectional view of a portion of the floor system taken along line 10—10 of FIG. 8.

Referring now to FIGS. 8 through 10, there is shown another embodiment of the present invention. In this embodiment, the floor panels 414 are employed to provide a subfloor and are comprised of sheets of plywood, particle board or the like. Preferably, the plywood sheets 414 are of a standard size such as $4\times8$ feet. As shown in FIGS. 9 and 10, the floor panels 414 are of the tongue and groove type to aid in providing a relatively smooth, continuous upper surface.

In the present embodiment, the support members 434 are in the form of a generally continuous lattice-like grid structure comprised of individual support members which extend generally perpendicular to each other and with one axis parallel to the axis of the floor panels 414. Preferably, the support members 434 are spaced about two inches apart in both directions. In the present embodiment, the grid of support members 434 are secured to the undersurface of the floor panels 414 prior to the floor panels 414 being transported to the location where they are to be installed. For example, the support members 434 may be secured to the floor panels 414 at the factory or other facility where the floor panels 414 are made. In the present embodiment, the support members 434 are secured to the undersurface of each of the floor panels 414 utilizing a one-component or two-component adhesive such as a hot-melt styrene resin, a solvent based styrene, a urethane or an epoxy. However, it should be understood that any other suitable moisture-resistant adhesive which provides a strong bond may alternatively be employed.

With the present embodiment, the elastomeric adhesive 418 is formed into uniform ridges 422 which are of a generally uniform width and depth or thickness in the manner as discussed in detail above. The floor panels 414 are installed in the same manner as discussed above. Of course, the floor panels 414 of the present embodiment have all of the features and advantages as discussed above in connection with the other embodiments. In addition, the floor system 410 of the present embodiment provides compensation for uneven areas in the support base 416. Such uneven areas may comprise small dips, particularly when the support base is concrete.

FIG. 9 shows a sectional view of portions of two of the installed floor panels 414 of FIG. 8. As discussed in detail above, the elastomeric adhesive 418 engages the undersurface of the floor panels 414 to provide a strong bond between the floor panels 414 and the support base 416.

FIG. 10 shows a cross sectional view similar to that of FIG. 9. However, in FIG. 10 a portion of the support base 416' is slightly lower than the remainder of the support base 416, resulting in a slight dip in the support surface. In a given application, the thickness of the adhesive 418 generally remains constant. When the floor panels 414 are installed, substantially all of the undersurface of the left panel (when viewing FIG. 10) engages the adhesive 418 as discussed above to form a strong bond with the support base 416. As previously indicated, the tongue and groove feature of the floor panels 414 is provided to maintain the upper surfaces of the floor panels 414 at substantially the same height. Thus, in the case of the right floor panel (when viewing FIG. 10), the adhesive 418 does not engage the complete undersurface of the floor panel 414, particularly around the area of the dip 416' in the support base 416. Instead, the support members 434 proximate the dip in the support base 416' are bonded by the adhesive 418 to the support base 416. The support members 434, in cooperation with the adhesive 418, provide the necessary resilient cushioning in the manner as described above.

Once all of the floor panels 414 have been installed, cracks between adjacent panels and all joints between the panels and side walls may be sealed utilizing a known waterproof joint sealing compound such as a urethane elastomer or a silicone (not shown).

In this manner, the subfloor 414 can be protected against the entry of accidental surface water which may be introduced to the surface of the floor by a broken pipe or similar mishap. A wide variety of surfacings may be installed over subfloor 414 such as vinyl surfacing 440, wall-to-wall carpet, mosaic tiles, or any other type of floor surface. The subfloor system 410 provides the desired uniform resilient cushioning, the elastic energy return, the impact-sound attenuation and the moisture protection necessary when placing a floor on a moisture-prone surface, such as an on-grade concrete support base 416.

Figure 11:
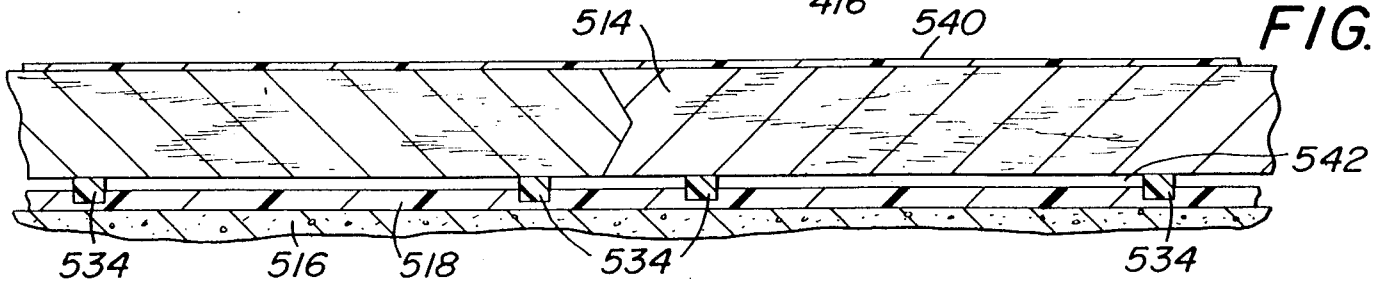
FIG. 11 is a sectional view of a floor system in accordance with yet another embodiment of the present invention.

FIG. 11 shows a variation of the embodiment of FIGS. 8 through 10. All of the features of the embodiment shown in FIGS. 8 through 10 are the same in FIG. 11, except that the thickness of the support members 534 is greater than the thickness or depth of the adhesive 518 so that the adhesive 518 does not engage the undersurface of the floor panels 514. Instead, the adhesive 518 is employed for bonding the elastomeric support members 534 to the support base 516 with a space 542 between the floor panels 514 and the adhesive 518. In this embodiment, since the elastomeric support members 534 provide the primary resiliently cushioned support for the floor panels 514, the adhesive 518 need not be elastomeric but could be any other suitable type of adhesive, such as a polyvinylacetate or an epoxy adhesive. Additionally, since the primary support for the floor panels 514 is provided by the support members 534, it is preferred that the support members 534 be positioned closer together than was done in the above-discussed embodiments. For example, if the support members 534 are formed into a square grid structure, the support members should be spaced about one inch on center.

Figure 12:
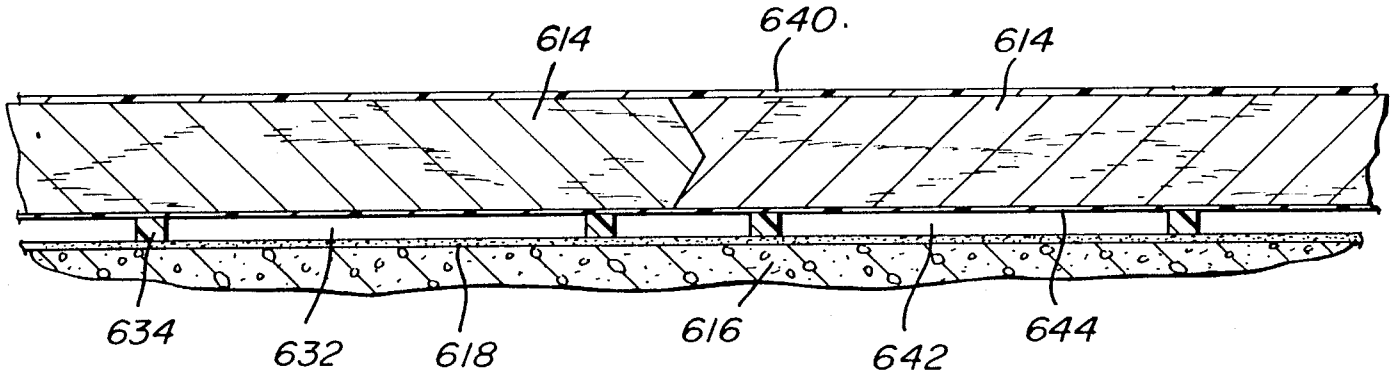
FIG. 12 is a sectional view of a floor system in accordance with yet another embodiment of the present invention.

FIG. 12 shows a variation of the embodiment of FIG. 11. In the embodiment shown in FIG. 12, a thin, generally continuous membrane layer 644 is positioned between the undersurface of the floor panels 614 and the top surfaces of the elastomeric support members 634. The membrane layer 644 may be made of the same material as the elastomeric support members 634 or may be made of some other material which exhibits good hydrolytic stability to avoid degeneration from exposure to moisture and which exhibits a low perm rating to protect the flooring members 614 from moisture vapor which might penetrate through support base 616. The membrane layer 644 should have a thickness which is less than the thickness 38 of the elastomeric support members 634.

As shown in FIG. 12, the membrane layer 644 is positioned between the bottom surface of the floor panels 614 and the top or upper surface of the support members 634. Preferably, the membrane layer 644 is secured to the upper surface of the support members 634 at the time the support members are fabricated. For example, elastomeric support members 634 and membrane layer 644 could be formed in one integral unit by injection molding and, in this manner, would be a continuous structure. The combination support members 634 and membrane layer 644 are then secured to the undersurface of the floor panels 614, either at the facility where the floor panels are produced or, if desired, at the field installation location just prior to the time that the floor panels 614 are installed. Alternatively, the combination support members 634 and membrane layer 644 could be initially secured to the support base 616 by applying a thin layer of adhesive 618 to the support base 616 and then laying the support members 634 with the attached membrane layer 644 into the adhesive layer 618. After allowing a period of time for adhesive bonding to occur, a second application of adhesive could be applied to the upper surface of the membrane layer 644 or to the undersurface of the floor panels 614. The floor panels 614 could then be bonded to the upper surface of the membrane layer 644.

Alternatively, the membrane layer 644 could initially be separate from the support members 634. The support members 634 could initially be installed on the support base utilizing a thin layer of adhesive 618. After allowing time for adhesive bonding to occur, adhesive could be applied (for example, using a roller) to the upper surfaces of the support members 634. The membrane layer 644 could then be secured to the upper surfaces of the support members. Thereafter, the floor panels 614 could be bonded to the upper surface of the membrane layer 644, as described above.

Because of the increased contact area between the membrane layer 644 and the undersurface of the floor panels 614, the bond strength to the undersurface of the floor panels 614 is significantly increased over the bond strength achieved by bonding the floor panels 614 directly to the support members 634. In addition, because of the natural impermeability of the membrane layer 644 and because of the additional impermeability which could be derived from the use of elastomeric adhesive to bond floor members 614 to membrane 644, the passage of moisture or moisture vapor is substantially inhibited. This is a major advantage when wood flooring materials are applied over surfaces which are inherently damp, such as on-grade concrete slabs. The combination of the elastomeric adhesive layer 618, air space 642, support members 634, membrane layer 644 and the elastomeric adhesive layer securing the membrane layer 644 to floor panels 614 helps to protect the wood floor panels from unwanted warpage and expansion while, at the same time, providing all of the advantages of uniform resilient cushioning, elastic energy return, and impact-sound reduction discussed above.

From the foregoing description, it can be seen that the present invention comprises a resiliently-cushioned adhesively-applied floor system which includes a plurality of elongated support members to provide continuous cushioned support. It will be recognized by those skilled in the art that changes may be made to the above-described embodiments of the invention without departing from the broad inventive concepts thereof. It is understood, therefore, that this invention is not limited to the particular embodiments disclosed, but is intended to cover any modifications which are within the scope and spirit of the invention as defined by the appended claims.

I claim:

1. A resiliently-cushioned adhesively-applied floor system comprised of a plurality of floor panels secured to a support base by an elastomeric adhesive of trowelable consistency, the adhesive being spread on at leat one of the floor panels or the support base in spaced ridges of a generally uniform thickness, the floor panels being forced toward the support base so that the adhesive ridges form an intimate bond between the floor panels and the support base, the improvement comprising:

a plurality of spaced elongated support member means fabricated of a pre-cured elastomeric material, the support member means having a thickness less than the initial thickness of the uncured adhesive ridges, the support member means being positioned between the floor panels and the support base and being spaced from each other for providing both initial and permanent resilient cushioned support to the floor panels, the support member means engaging the floor panels, the support base and the adhesive when the floor panels are forced toward the support base, the spaces between the adhesive ridges, the adhesive and the support member means cooperating to provide cushioned resilient support for the floor panels.

2. The system as recited in claim 1 wherein the support member means comprise support members which are genreally parallel to each other.

3. The system as recited in claim 2 wherein the support members are uniformly spaced from each other by a predetermined distance.

4. The system as recited in claim 1 wherein the support member means comprise a generally continuous open grid having two groups of interengaging support members, the support members within each group being parallel to each other with the support members of one group not being parallel to the support members of the other group.

5. The system as recited in claim 4 wherein the support members of one group are generally perpendicular to the support members of the other group.

6. The system as recited in claim 1 wherein the support member means comprise support members which are initially secured to the floor panels.

7. The system as recited in claim 6 wherein at least a portion of at least some of the support members extends beyond the edges of the floor panels so that when the floor panels are bonded to the support base the portions of the support members extending beyond the edges of the floor panels provide at least partial support for the adjacent floor panels.

8. The system as recited in claim 1 wherein the support member means comprise support members which are initially secured to the support base.

9. The system as recited in claim 8 wherein a portion of at least some of the support members extends between adjacent floor panels.

10. The system as recited in claim 1 wherein the support member means are fabricated of a material having a Shore durometer in the range between A35 and A70.

11. The system as recited in claim 1 wherein the support member means are generally square in cross section.

12. The system as recited in claim 1 wherein the support member means are generally round in cross section.

13. The system as recited in claim 1 wherein the width of the support member means is at least slightly less than the initial width of the space between adjacent adhesive ridges.

14. The system as recited in claim 1 wherein the floor panels have a primary axis and wherein the support member means comprise at least two support members associated with each floor panel, the two support members being generally parallel to each other and generally perpendicular to the primary axis of the associated floor panels.

15. The system as recited in claim 1 further including a membrane layer of moisture-resistant material positioned between the support member means and the floor panels.

16. The system as recited in claim 15 wherein the membrane layer is initially secured to the support member means.

17. A method of making a resiliently-cushioned adhesively-applied floor system over a support base comprising the steps of:

providing a support base and a plurality of floor panels to be secured to the support base;

providing an elastomeric adhesive having a trowelable consistency;

applying the adhesive to at least one of the floor panels or the support base in spaced ridges of a generally uniform thickness;

positioning a plurality of spaced elongated support member means between the floor panels and the support base, the support member means for providing both initial and permanent resilient cushioned support to the floor panels, the support member means being fabricated of a pre-cured elastomeric material, the support member means having a thickness less than the initial thickness of the uncured adhesive ridges; and pressing the floor panels toward the support base so that the support member means engage the floor panels, the support base and the adhesive to form an intimate bond between the floor panels and the support base, the adhesive, the spaces between the adhesive ridges, and the support member means cooperating to provide cushioned, resilient support for the floor panels.

18. The method as recited in claim 17 and further including the step of securing the support member means to the floor panels prior to pressing the floor panels toward the support base.

19. The method as recited in claim 17 wherein the support member means are secured to the support base prior to the floor panels being pressed toward the support base.

20. The method as recited in claim 17 further comprising the step of forming the support member means into a generally continuous open grid having two groups of interengaging support members, the support members within each group being parallel to each other, but the support members of one group not being parallel to the support members of the other group.

21. The method as recited in claim 17 further including the step of positioning a membrane layer of moisture-resistant material between the support member means and the floor panels.

22. The method as recited in claim 17 further including the step of orienting the support member means associated with each floor panel so that at least two support members are generally perpendicular to the primary axis of the floor panel.

23. The method as recited in claim 17 further including the step of arranging the support member means to be generally parallel to each other.

24. A resiliently-cushioned adhesively-applied floor system comprised of a plurality of floor panels secured to a support base by an adhesive, the adhesive being spread on the support base with a generally uniform thickness, the floor panels including a plurality of spaced elongated support member means fabricated of a pre-cured elastomeric material and having a depth generally greater than the thickness of the adhesive, the support member means for providing both initial and permanent resilient cushioned support for the floor panels, the support member means being secured to the undersurface of the floor panels, the floor panels being forced toward the support base so that the support member means engage the support base and the adhesive forms a bond between the support member means and the support base, the adhesive and the support member means cooperating to provide cushioned resilient support for the floor panels.

25. The system as recited in claim 24 wherein the support member means are generally parallel to each other.

26. The system as recited in claim 24 wherein the support member means are uniformly spaced from each other by a predetermined distance.

27. The system as recited in claim 24 wherein the support member means comprise a generally continuous open grid having two groups of interengaging support members, the support members within each group being parallel to each other with the support members of one group not being parallel to the support members of the other group.

28. The system as recited in claim 27 wherein the support members of one group are generally perpendicular to the support members of the other group.

29. The system as recited in claim 24 wherein at least a portion of at least some of the support member means extends beyond the edges of the floor panels so that when the floor panels are bonded to the support base the portions of the support member means extending beyond the edges of the floor panels provide at least partial support for the adjacent floor panels.

30. The system as recited in claim 24 wherein the support member means are fabricated of a material having a Shore durometer in the range between A35 and A70.

31. The system as recited in claim 24 wherein the support member means are generally square in cross section.

32. The system as recited in claim 24 wherein the support member means are generally round in cross section.

33. The system as recited in claim 24 wherein the floor panels have a primary axis and wherein at least two support members are associated with each floor panel, the two support members being generally parallel to each other and generally perpendicular to the primary axis of the associated floor panel.

34. The system as recited in claim 24 further including a membrane layer of moisture-resistant material secured to the upper surfaces of the support member means.

35. A method of making a resiliently-cushioned adhesively-applied floor system over a support base comprising the steps of:

providing a support base and a plurality of floor panels to be secured to the support base;

providing an adhesive;

applying the adhesive to the support base with a generally uniform thickness;

securing a plurality of spaced elongated support member means to the underside of the floor panels, the support member means being fabricated of a pre-cured elastomeric material, the support member means for providing both initial and permanent resilient cushioned support for the floor panels, the support member means having a depth generally greater than the thickness of the adhesive; and pressing the floor panels toward the support base so that the support member means engage the support base and the adhesive forms a bond between the support member means and the support base, the adhesive and the support member means cooperating to provide resilient support for the floor panels.

36. The method as recited in claim 35 further comprising the step of forming the support member means into a generally continuous open grid having two groups of interengaging support members, the support members within each group being parallel to each other, but the support members of one group not being parallel to the support members of the other group.

37. The method as recited in claim 35 further including the step of orienting the support member means associated with each floor panel so that at least two support members are generally perpendicular to the primary axis of the floor panel.

38. The method as recited in claim 35 further including the step of arranging the support member means to be generally parallel to each other.

39. The method as recited in claim 35 further including the step of positioning a membrane layer of moisture-resistant material between the support member means and the floor panels.

40. A support assembly for supporting a floor panel with resilient cushioning comprising:

a plurality of spaced elongated support member means fabricated of a pre-cured elastomeric material, the support member means for providing both initial and permanent resilient cushioned support for the floor panel; and a membrane layer of moisture-resistant material secured to the support member means.

41. The support assembly as recited in claim 40 wherein the support member means includes support members which are generally parallel to each other.

42. The support assembly as recited in claim 40 wherein the support member means comprise a generally continuous open grid having two groups of interengaging support members, the support members within each group being parallel to each other.

43. The support assembly as recited in claim 42 wherein the support members of one group are generally perpedicular to the support members of the other group.

44. The support assembly as recited in claim 40 wherein the support member means are fabricated of a material having a Shore durometer of between A35 and A70.

45. The support assembly as recited in claim 40 wherein the membrane is fabricated of an elastomeric material.

* * * * *